US011976912B1

(12) United States Patent
Lee

(10) Patent No.: US 11,976,912 B1
(45) Date of Patent: May 7, 2024

(54) ARROWHEAD HAVING EXPANDING BLADES

(71) Applicant: Young Ki Lee, Busan (KR)

(72) Inventor: Young Ki Lee, Busan (KR)

( * ) Notice: Subject to any disclaimer, the term of this patent is extended or adjusted under 35 U.S.C. 154(b) by 0 days.

(21) Appl. No.: 18/148,434

(22) Filed: Dec. 30, 2022

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 4,166,619 | A * | 9/1979 | Bergmann | F42B 6/08 | 473/581 |
| 4,579,348 | A * | 4/1986 | Jones | F42B 6/08 | 473/583 |
| 4,973,060 | A | 11/1990 | Herzing | | |
| 4,976,443 | A * | 12/1990 | DeLucia | F42B 6/08 | 473/583 |
| 5,066,021 | A | 11/1991 | Delucia | | |
| 5,082,292 | A | 1/1992 | Puckett et al. | | |
| 6,200,237 | B1 | 3/2001 | Barrie | | |
| 6,258,000 | B1 | 7/2001 | Liechty, II | | |
| 6,287,223 | B1 | 9/2001 | Liechty, II | | |
| 6,322,464 | B1 * | 11/2001 | Sestak | F42B 6/08 | 473/583 |
| 6,554,727 | B1 * | 4/2003 | Armstrong | F42B 6/08 | 473/583 |
| 6,669,586 | B2 | 12/2003 | Barrie et al. | | |
| 6,830,523 | B1 * | 12/2004 | Kuhn | F42B 6/08 | 473/583 |
| 7,226,375 | B1 * | 6/2007 | Sanford | F42B 6/08 | 473/583 |
| 7,677,995 | B1 * | 3/2010 | Sanford | F42B 6/08 | 473/583 |
| 7,713,152 | B1 * | 5/2010 | Tentler | F42B 6/08 | 473/583 |
| 8,062,155 | B2 | 11/2011 | Butcher | | |
| 8,545,349 | B1 * | 10/2013 | Budris | F42B 6/08 | 473/582 |
| 10,281,250 | B2 * | 5/2019 | Beck | F42B 6/08 | |

* cited by examiner

*Primary Examiner* — John A Ricci
(74) *Attorney, Agent, or Firm* — JCIPRNET

(57) ABSTRACT

The present disclosure relates to an arrowhead having expanding blades, the arrowhead including: a main body having a fitting slot longitudinally formed and having two expanding blade coupling portions on an outer surface thereof; a blade assembly having a rear end fitted in the fitting slot of the main body, having leading edges on both sides of the front thereof, having a guide pin seat hole on a plate surface in which a guide pin is seated, and having a guide hole extending from the guide pin seat hole; and expanding blades each having a hinge shaft coupling hole at one end to be coupled to be hinge-rotatable to the expanding blade coupling portion by a hinge shaft, further having a protrusion at the one end, and having a blade at the front, wherein when the blade assembly is moved rearward, the guide pin pushes the protrusions of the expanding blades so that the expanding blades are unfolded.

4 Claims, 6 Drawing Sheets

ARROWHEAD HAVING EXPANDING BLADES

BACKGROUND OF THE INVENTION

1. Field of the Invention

The present disclosure relates to an arrowhead, in detail, an arrowhead for hunting in which expanding blades are folded or unfolded by a relative motion between a main body and a blade assembly.

2. Description of the Related Art

In general, an arrow is composed of a shaft that is a hollow body, an arrowhead mounted at the front end of the shaft, a notch for fitting a bowstring, and feathers for securing stable flight of the arrow.

The arrow of these components is the one that actually passes through a target. As energy accumulated in the arrow is concentrated when the arrow hits a target, the arrow should have excellent wear resistance and strength and a structure that can secure stable flight of the arrow.

In general, arrows have a pointed front end to have excellent penetration ability; however, there is a problem that such arrowheads having excellent penetration ability are not suitable for specific hunting. This is, because pointed arrowheads do not give large games a mortal wound, it is difficult to quickly overpower games. Considering this matter, broadheads that have two to four sharp blades on the edge of a pointed arrowhead or can induce severe bleeding of game are used.

Meanwhile, since the blades mounted on the edge of the arrowhead of such broadheads can affect flight stability of an arrow, many arrowheads having a structure in which blades are folded in normal time and unfolded when the arrowheads hit a target have been well known.

Such a foldable blade is called an expanding blade, and as patent documents having such an expanding blade, there have been disclosed U.S. Pat. No. 5,082,292, "BROADHEAD WITH DEPLOYABLE CUTTING BLADES", U.S. Pat. No. 5,066,021, "ARROW SYSTEM", U.S. Pat. No. 4,973,060, "ARROHEAD WITH EXPANDABLE BLADES", U.S. Pat. No. 6,669,586, "EXPANDING BROADHEAD", U.S. Pat. No. 6,258,000, "PENETRATION ENHANCING AERODYNAMICALLY FAVORABLE ARROWHEAD", U.S. Pat. No. 6,287,223, "DULLING PREVENTION FOR SHARP CUTTING EDGE OF BLADE-OPENING ARROWHEAD BLADES WHEN IN A CLOSED IN-FLIGHT POSITION", U.S. Pat. No. 8,062,155, "ARROWHEAD HAVING BOTH FIXED AND MECHANICALLY EXPANDABLE BLADES", and U.S. Pat. No. 6,200,237, "SLIDING BODY EXPANDING BROADHEAD", etc.

These U.S. patents all have 2 to 4 expanding blades and have a configuration for increasing a killing and injuring ability by unfolding several expanding blades to cut deeper into an injury of games when an arrow hits a target such as games.

However, such expanding blades of the related art have a defect that the expanding blades are unexpectedly unfolded when an arrow flies after shot, so they may be a disadvantage in accuracy rate and flying distance.

Due to this problem, according to an arrowhead having such expanding blades of the related art, in general, several expanding blades are gathered in advance before an arrow is shot and are then tied with a band or a string made of a material that is easily cut or separated when the arrow hits a target.

Accordingly, expanding blades are folded while an arrow flies and then are unfolded while the band or string is separated at the moment that the arrow hits and penetrates a target.

However, for the manner of folding and tying or fastening the expanding blades with a band, etc., there is a trouble that it is required to fasten the folded expanding blades with a band, etc. every time a user shoots an arrow, so there is a trouble that a user has to always carry bands when hunting.

Accordingly, there is a need for developing an arrowhead having a structure that can secure stable flight by preventing folded expanding blades from being unfolded while an arrow flies by itself even without using a specific tool and that allows expanding blades to be automatically unfolded only when an arrow hits and penetrates a target.

CITATION LIST

Patent Literature

Patent Literature 1: U.S. Pat. No. 5,082,292
Patent Literature 2: U.S. Pat. No. 5,066,021
Patent Literature 3: U.S. Pat. No. 4,973,060
Patent Literature 4: U.S. Pat. No. 6,669,586
Patent Literature 5: U.S. Pat. No. 6,258,000
Patent Literature 6: U.S. Pat. No. 6,287,223
Patent Literature 7: U.S. Pat. No. 8,062,155
Patent Literature 8: U.S. Pat. No. 6,200,237

SUMMARY OF THE INVENTION

An objective of the present disclosure is to provide an arrowhead having two expanding blades that can be folded or unfolded when necessary, and are folded even without a specific tool while an arrow flies and are then quickly and surely unfolded only when the arrow hits a target.

In order to achieve the objectives, an aspect of the present disclosure provides an arrowhead having expandable blades, the arrowhead including: a main body 10 having a fitting slot 11 longitudinally formed and having two expanding blade coupling portions 12 on an outer surface thereof; a blade assembly 20 having a rear end fitted in the fitting slot 11 of the main body 10, having leading edges 21 on both sides of the front thereof, having a guide pin seat hole 22 on a plate surface in which a guide pin 25 is seated, and having a guide hole 23 extending from the guide pin seat hole 22; and expanding blades 30 each having a hinge shaft coupling hole 32 at one end to be coupled to be hinge-rotatable to the expanding blade coupling portion 12 by a hinge shaft 60, further having a protrusion 35 at the one end, and having a blade 31 at the front, wherein when the blade assembly 20 is moved rearward, the guide pin 25 pushes the protrusions 35 of the expanding blades 30 so that the expanding blades 30 are unfolded.

An O-ring seat groove 18 in which an O-ring 19 is seated is formed at the rear end of the main body 10, and an O-ring coupling groove 33 that is fitted on the O-ring 19 is formed at the other end of the expanding blade 30, so the expanding blades are kept unfolded when the arrowhead is flying.

Further, a mounting threaded-portion 15 extending rearward may be formed at the rear end of the main body 10.

Further, an expanding blade seat groove 14 may be formed at the expanding blade coupling portion 12, and the one end of the expanding blade 30 may be accommodated therein.

DETAILED DESCRIPTION OF THE PREFERRED EMBODIMENTS

Hereafter, the configuration and operation principle of the present disclosure are described in detail with reference to the accompanying drawings.

Figure 1:
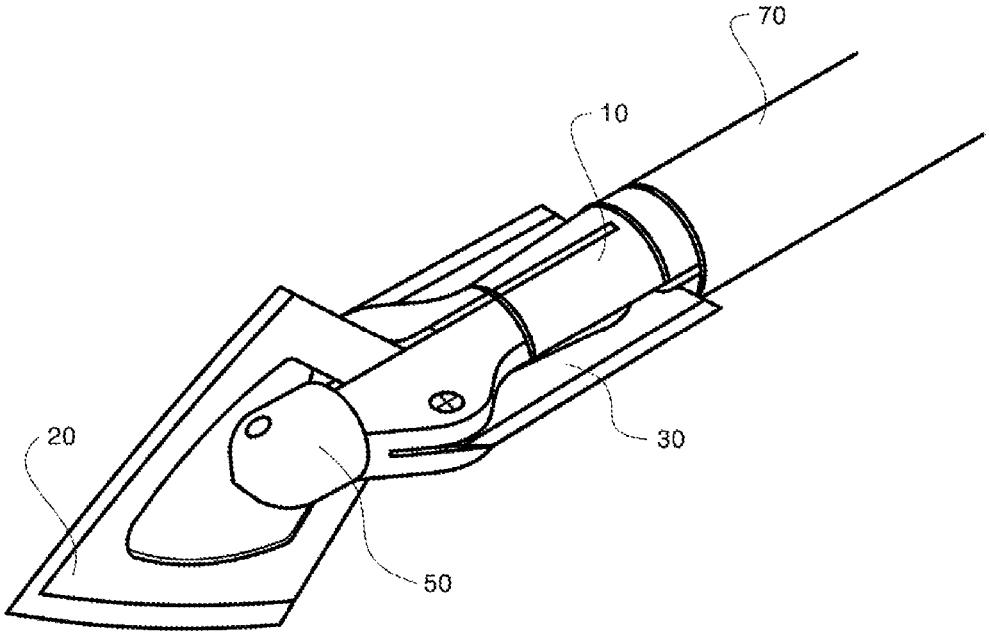
FIG. 1 is a perspective view showing the external appearance of an arrowhead with expanding blades folded in accordance with the present disclosure.
Figure 2:
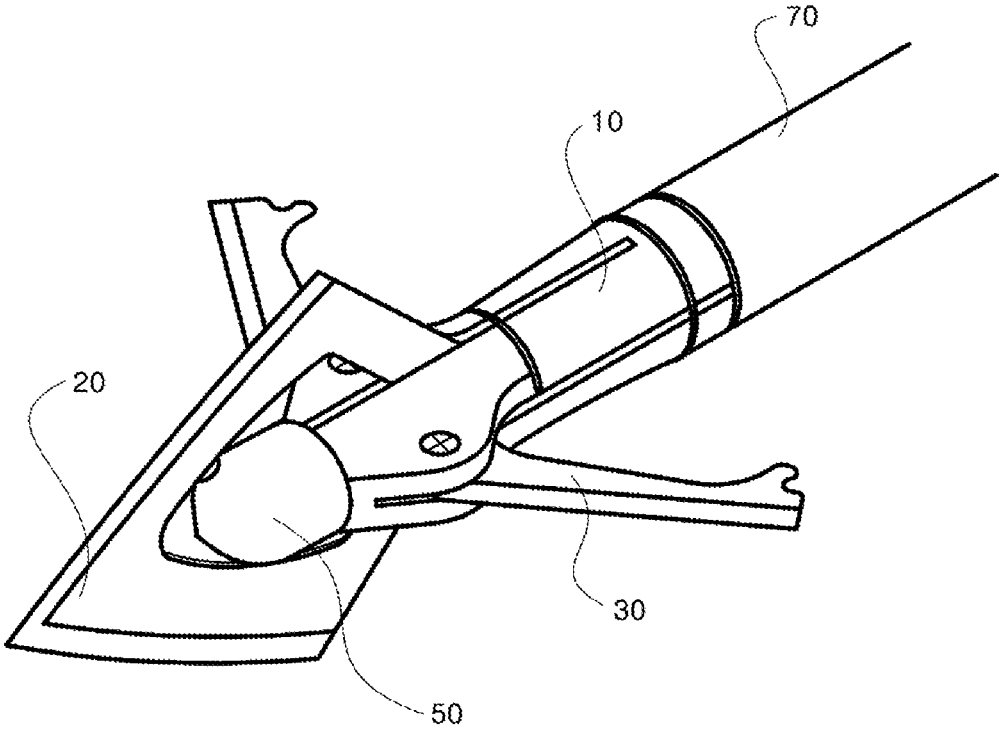
FIG. 2 is a perspective view showing the external appearance of the arrowhead with the expanding blades unfolded in accordance with the present disclosure.
Figure 3:
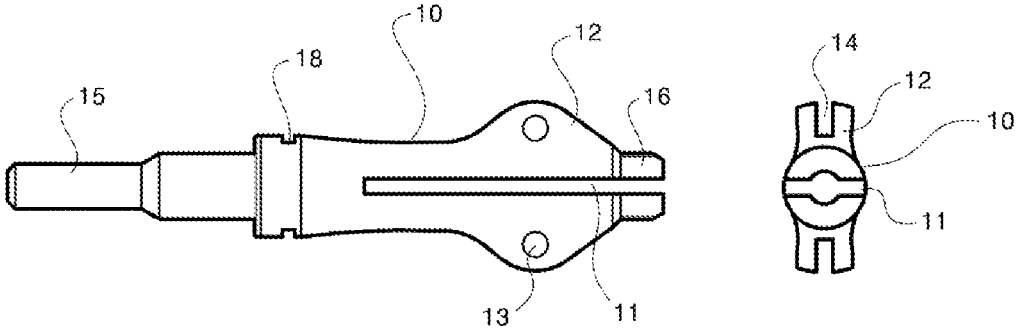
FIG. 3 is a side view and a front view of a main body according to the present disclosure.
Figure 4:
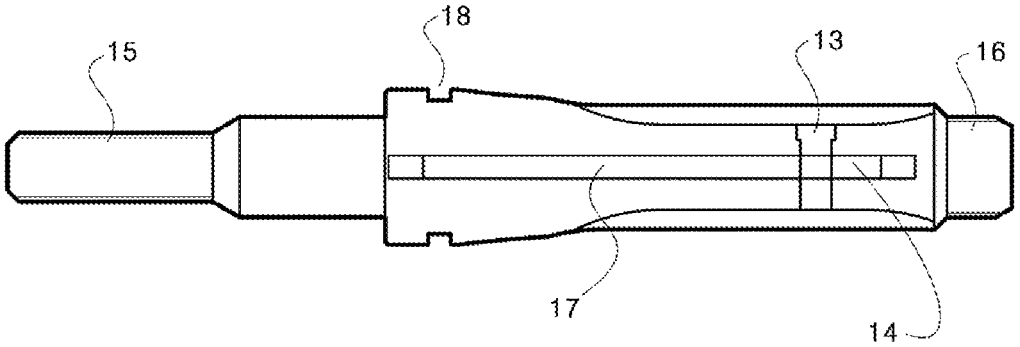
FIG. 4 is a plan view of the main body according to the present disclosure.
Figure 5:
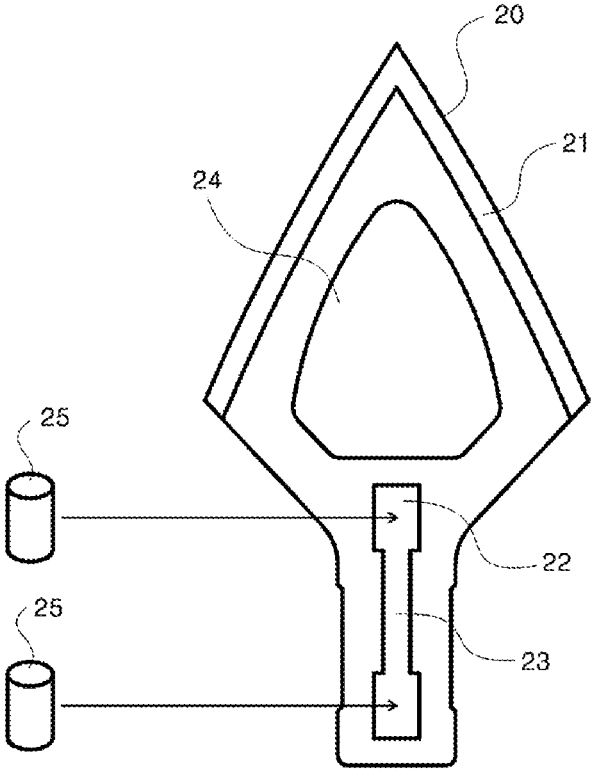
FIG. 5 is a view showing a blade assembly according to the present disclosure.
Figure 6:
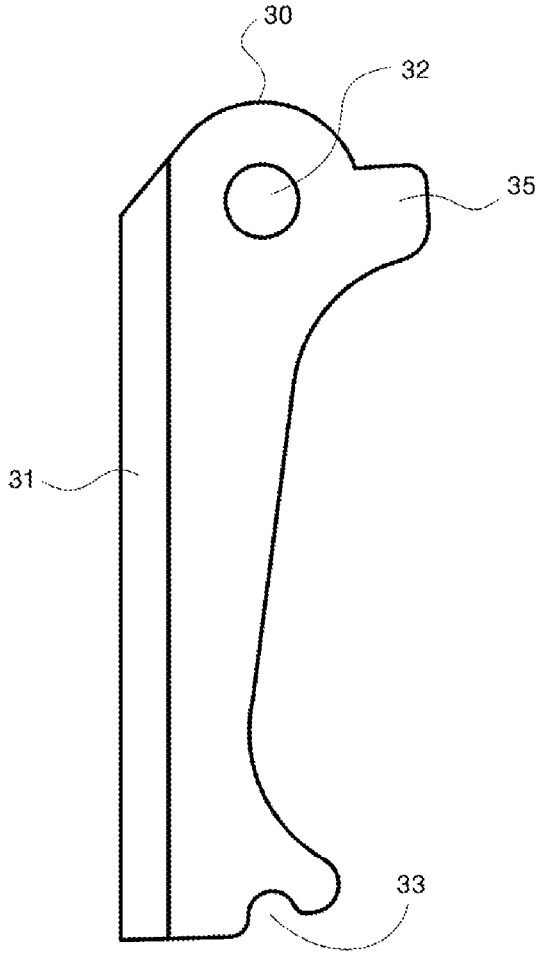
FIG. 6 is a view showing an expanding blade according to the present disclosure.
Figure 7:
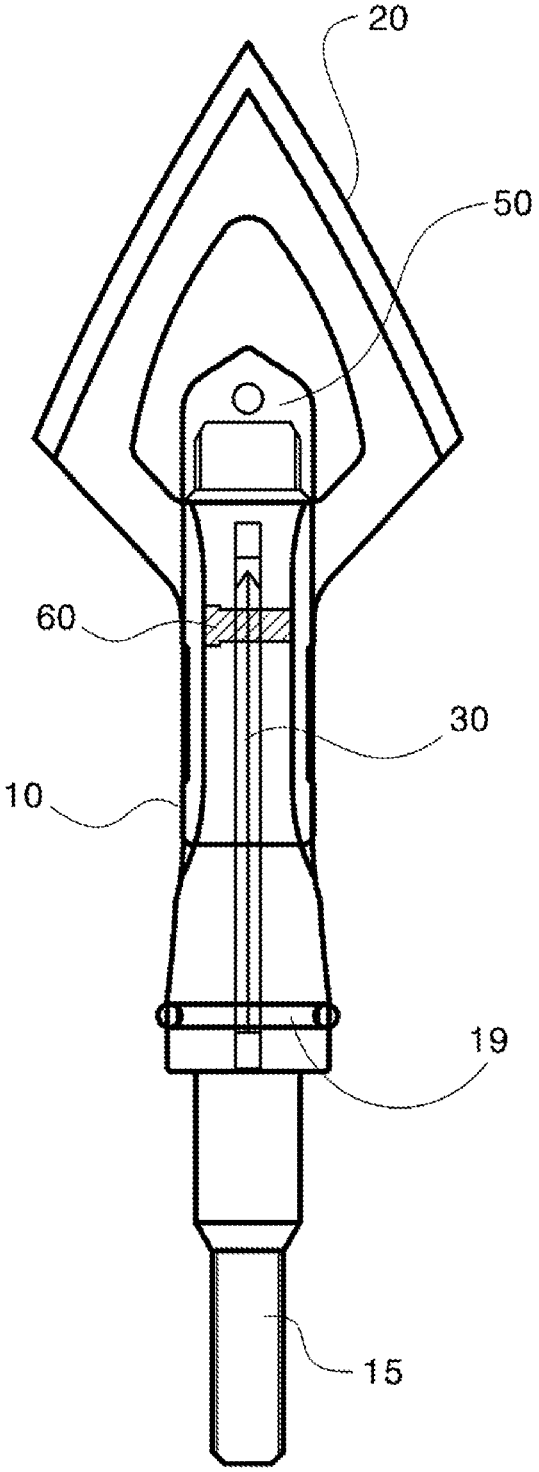
FIG. 7 is a side view of the arrowhead with the expanding blades folded in accordance with the present disclosure.
Figure 8:
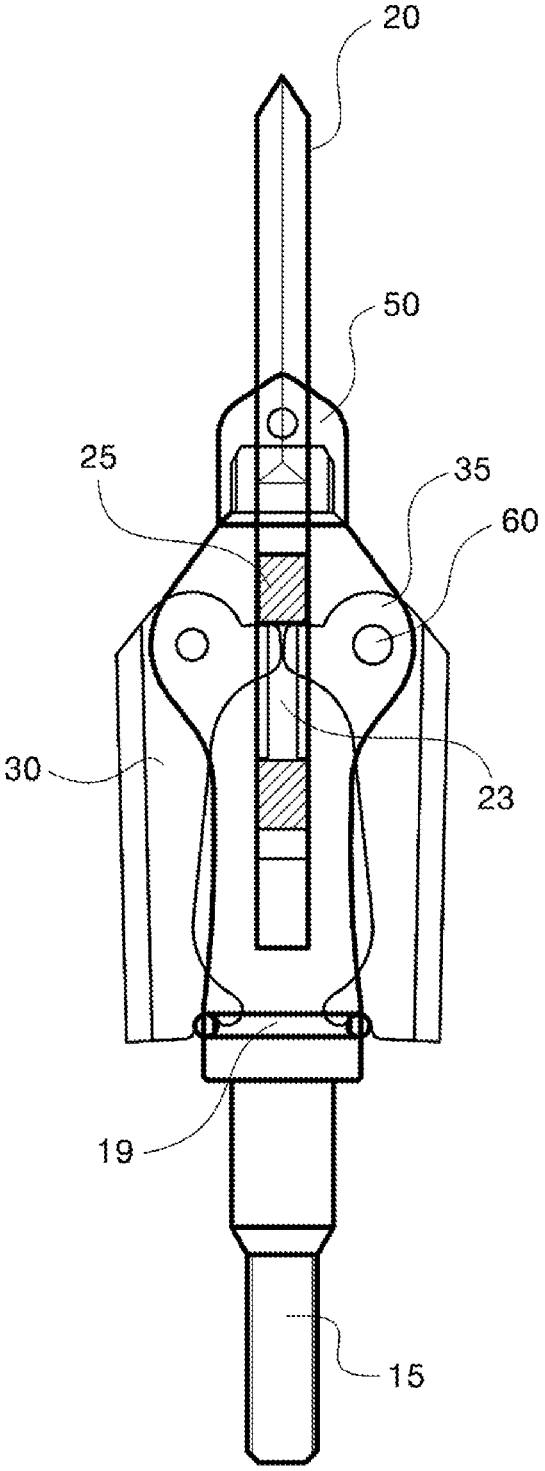
FIG. 8 is a plan view of the arrowhead with the expanding blades folded in accordance with the present disclosure.
Figure 9:
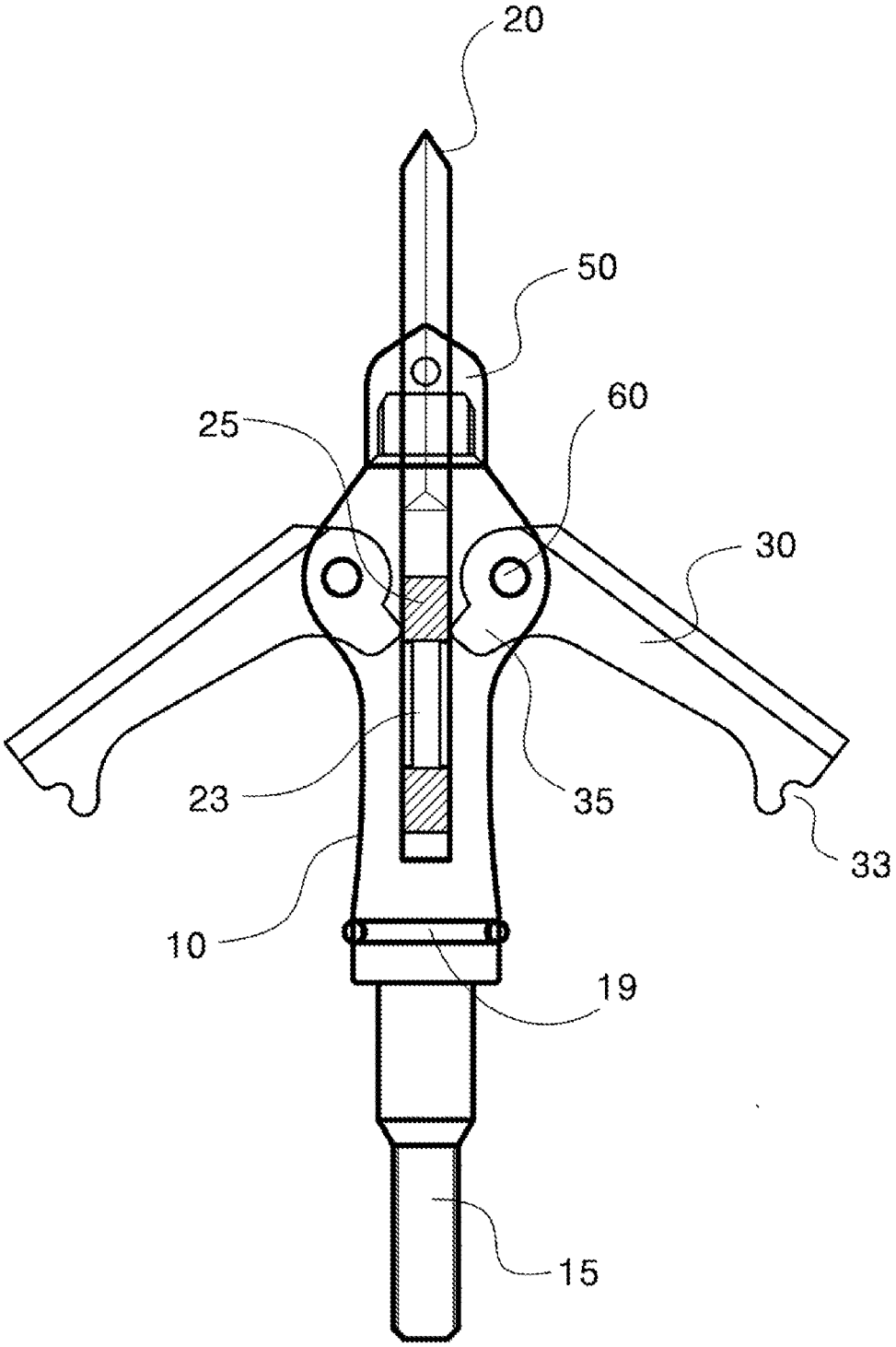
FIG. 9 is a plan view of the arrowhead with the expanding blades unfolded in accordance with the present disclosure.

FIGS. 1, 7, and 8 are views showing an arrowhead with expanding blades folded in accordance with the present disclosure, FIGS. 2 and 9 are views showing the arrowhead with the expanding blades unfolded in accordance with the present disclosure, FIGS. 3 and 4 are views showing a main body according to the present disclosure, FIG. 5 is a view showing a blade assembly according to the present disclosure, and FIG. 6 is a view showing an expanding blade according to the present disclosure.

An arrowhead 100 of the present disclosure, in a broad meaning, is composed of a blade assembly 20 supposed to penetrate into a target, a main body 10 in which the blade assembly 20 is fitted, and two expanding blades 30 rotatably mounted on the main body 10.

FIGS. 1, 7, 8 show the state in which several expanding blades 130 are folded, and particularly, FIGS. 7 and 8 are shown transparently so that the internal structure is seen.

FIGS. 3 and 4 are a side view, a front view, and a plan view of the main body 10 according to the present disclosure. The main body 10 has an entirely cylindrical shape, and a fitting slot 11 being open at the front is longitudinally formed with a predetermined depth in the main body 10. Two expanding blade coupling portions 12 protrude from the outer surface of the main body 10. A hinge shaft coupling hole 13 is formed through a side of the expanding blade coupling portion 12 and, as shown in figures, an expanding blade seat groove 14 is formed therein. The expanding blade seat groove 14 is formed to communicate with the fitting slot 11 of the main body 10.

An O-ring seat groove 18 is formed on the outer surface of the rear end of the main body 10 so that an O-ring 19 is seated in the O-ring seat groove 18.

Meanwhile, a cut portion 17 extending rearward from the expanding blade seat groove 14 is formed on a side of the main body 10, so expanding blades 30 to be described below can be inserted into the cut portion 17 when they are folded.

Further, a mounting threaded-portion 15 for fixing an arrowhead of the present disclosure by being thread-fastened to an arrow shaft 70 is formed at the rear end of the main body 10. Further, a front end tip coupling threaded-portion 16 to which a front end tip 50, which prevents separation of the blade assembly 20 by closing the front end of the open fitting slot 11, is formed at the front end of the main body 10.

As shown in FIG. 5, the blade assembly 20 has leading edges 21 on both sides of the front to be able to easily penetrate a target. A guide pin seat hole 22 in which a guide pin 25 is seated is formed at the rear end of the blade assembly 20, and a guide hole 23 extends from the guide pin seat hole 22. The guide pin 25 and the guide hole 23 are important features of the present disclosure and are components that induce the expanding blades 30 to be able to expand when an arrowhead hits a target. The guide pin 25 has a cylindrical shape in figures, but the shape is not specifically limited and may be a hexahedron. It is apparent that the internal shape of the fitting slot 11 is changed to correspond to the shape of the guide pin 25.

Only one guide pin 25 may be provided at the front of the guide hole 23 and, as shown in FIG. 5, the guide pin 25 may be provided at both the front and rear of the guide hole 23.

The guide pin 25 is fitted into the guide pin seat hole 22, and then the rear end of the blade assembly 20 is inserted into the fitting slot 11 of the main body 10. After the blade assembly 20 is inserted, the front end tip 50 is thread-fastened to the front end tip coupling threaded-portion 16 to prevent the blade assembly 20 from being separated from the main body 10. Though not shown, a cap may be fitted first before the front end tip 550 is fastened.

Further, as can be seen from FIGS. 1 and 2, it is preferable that an opening 24 is formed in the blade assembly 20 so that the front end tip 50 can be accommodated.

The blade assembly 20, as shown in FIGS. 8 and 9, is configured such that the guide pin 25 can be moved forward and rearward in the fitting slot 11.

As shown in FIGS. 1, 2, 8, and 9, the expanding blades 30 are configured to be unfolded to both sides when the arrowhead of the present disclosure hits a target so that they give a greater injury to a target. As shown in FIG. 6, the expanding blade 30 is, in a broad meaning, composed of a blade 31 formed at the front, a protrusion 35 protruding from one end, and an O-ring coupling groove 32 formed at the other end, and a hinge shaft coupling hole 32 is formed through the one end.

The one end of the expanding blade 30 is fitted into the expanding blade seat groove 14 formed inside the expanding blade coupling portion 12 of the main body 10, and a hinge shaft 60 is coupled with the hinge shaft coupling hole 13 of the expanding blade coupling portion 12 and the hinge shaft coupling hole 32 of the expanding blade 30 aligned with each other, whereby the expanding blade 30 is rotatably coupled to the main body 10.

The O-ring coupling groove 33 that is fitted on the O-ring 19 of the main body 10 is formed at the other end of the expanding blade 30.

FIG. 8 is a view showing the state in which the arrowhead of the present disclosure is ready to shoot and the state in which the arrowhead is flying after shooting. In this case, the expanding blades 30 are folded with the blade assembly 20 positioned as forward as possible, and the protrusions 35 of the expanding blades 30 are in contact with the rear end of the guide pin 25. To this end, it is preferable to set the protrusion distance of the protrusions 35 such that the protrusions 35 can be sufficiently in contact with the rear end of the guide pin 25, and the protrusions may be configured to extend to the guide hole 23. Further, the O-ring fitting groove 33 of the expanding blade 30 is fitted on the O-ring 19. Since the O-ring coupling groove 33 and the O-ring 19 are fitted to each other, the expanding blades 30 and the blade assembly 20 are firmly fixed so that the expanding blades 30 are not shaken or unfolded and the blade assembly 20 is not pushed rearward while an arrow flies.

FIG. 9 shows the state in which the arrowhead of the present disclosure hits a target. In this case, the blade assembly 20 is pushed rearward and the guide pin 25 is also pushed rearward. Here, the guide pin 25 pushes the protrusions 35 of the expanding blades 30 rearward, and the O-ring coupling groove 33 fitted on the O-ring 19 is separated by this force, whereby the expanding blades 30 are unfolded.

According to the arrowhead of the present disclosure having this structure, when an arrow flies without specific impact, the expanding blades 30 are kept stably folded and are quickly and efficiently unfolded when the arrow hits a target.

Although the present disclosure was described with reference to exemplary embodiments, the embodiments are only examples and it would be apparent to those skilled in the art that the present disclosure is not limited thereto and may be modified in various ways, and specific technological characteristics may be added on the basis of the spirit of the present disclosure.

According to the present disclosure, since expanding blades mounted on an arrowhead are kept folded when an arrow is flying and unfolded only when the arrow hits a target, there is an advantage that an arrow can stably fly and can have excellent killing and injuring ability against a target.

In particular, the mechanical configuration for folding and unfolding the expanding blades on time is simple, so there is an advantage that the arrowhead can be easily manufactured and hardly breaks.

What is claimed is:

1. An arrowhead having expanding blades, comprising:

a main body having a fitting slot longitudinally formed and having two expanding blade coupling portions on an outer surface thereof;

a blade assembly having a rear end fitted in the fitting slot of the main body, having leading edges on both sides of the front thereof, having a guide pin seat hole at the rear end in which a guide pin is seated, and having a guide hole extending from the guide pin seat hole; and expanding blades each having a hinge shaft coupling hole at one end to be coupled to be hinge-rotatable to the expanding blade coupling portion by a hinge shaft, further having a protrusion at the one end, and having a blade at the front, wherein when the blade assembly is moved rearward, the guide pin pushes the protrusions of the expanding blades so that the expanding blades are unfolded.

2. The arrowhead of claim 1, wherein an O-ring seat groove in which an O-ring is seated is formed at the rear end of the main body, and an O-ring coupling groove that is fitted on the O-ring is formed at the other end of the expanding blade, so the expanding blades are kept unfolded when the arrowhead is flying.

3. The arrowhead of claim 1, wherein a mounting threaded-portion extending rearward is formed at the rear end of the main body.

4. The arrowhead of claim 1, wherein an expanding blade seat groove is formed at the expanding blade coupling portion and the one end of the expanding blade is accommodated therein.

* * * * *